US007290380B2

(12) United States Patent
Natterer

(10) Patent No.: US 7,290,380 B2
(45) Date of Patent: Nov. 6, 2007

(54) PACKAGING MACHINE AND METHOD FOR CLOSING CONTAINERS

(75) Inventor: Johann Natterer, Legau (DE)

(73) Assignee: MULTIVAC Sepp Haggenmuller GmbH & Co. KG, Wolfertschwenden (DE)

( * ) Notice: Subject to any disclaimer, the term of this patent is extended or adjusted under 35 U.S.C. 154(b) by 95 days.

(21) Appl. No.: 11/126,811

(22) Filed: May 11, 2005

(65) Prior Publication Data

US 2005/0268579 A1 Dec. 8, 2005

(30) Foreign Application Priority Data

May 12, 2004 (DE) ..... 10 2004 023 474

(51) Int. Cl.
*B65B 7/00* (2006.01)

(52) U.S. Cl. ..... 53/309; 53/152; 53/485

(58) Field of Classification Search ..... 53/310, 53/267, 268, 280, 282, 374.5, 371.5, 373.5, 53/281, 287, 485, 553, 152, 309
See application file for complete search history.

(56) References Cited

U.S. PATENT DOCUMENTS 3,092,941 A 6/1963 Baker et al.
3,654,746 A * 4/1972 Beckers ..... 53/471
4,018,028 A * 4/1977 Donnet ..... 53/51
4,974,392 A * 12/1990 Mondini ..... 53/287
5,001,886 A * 3/1991 Turtschan ..... 53/167
5,065,563 A 11/1991 Robache
5,385,003 A * 1/1995 Nixon et al. ..... 53/471
5,475,965 A * 12/1995 Mondini ..... 53/287
5,603,203 A * 2/1997 Robache ..... 53/559
5,682,729 A * 11/1997 Buchko ..... 53/453
6,282,866 B1 * 9/2001 Natterer et al. ..... 53/282
2004/0098947 A1 * 5/2004 Konishi ..... 53/329.5

FOREIGN PATENT DOCUMENTS

DE 81 15 644 11/1982
EP 0 680 880 A1 11/1995

* cited by examiner

*Primary Examiner*—Thanh Truong
(74) *Attorney, Agent, or Firm*—McDonnell Boehnen Hulbert & Berghoff LLP

(57) ABSTRACT

A packaging machine for closing containers (5) is provided having a supply device (1, 2) for supplying containers (5) to be closed; a removal device (11) for removing closed containers (5"); and a closing device (25) between the supply device (1, 2) and the removal device (11). The closing device (25) is arranged lateral of a main transport path (8) of the containers (5) from the supply device (2) to the removal device (11) and a device is provided which transports at least one container (5) to be closed into the closing device (25) by means of a linear motion while transporting at least one closed container (5") out from the closing device (25).

8 Claims, 3 Drawing Sheets

PACKAGING MACHINE AND METHOD FOR CLOSING CONTAINERS

FIELD OF THE INVENTION

The present invention relates to a packaging machine and to a method for closing containers.

BACKGROUND OF THE INVENTION

Packaging machines, so-called tray closing machines, are known in which products are packaged into pre-fabricated tray-shaped containers and closed with a film.

From DE 690 03 503 a packaging machine is known in which the packaging containers are transported from a filling station onto a plate in a sealing station by means of circulating drivers. It is disadvantageous that the positioning of the containers takes place in an imprecise way and takes a lot of time since the acceleration must remain low and the drivers must return from the region of the sealing station.

From EP 680 880 a machine is known in which the containers are directly transported from a supply unit into a closing device (sealing station) by pusher arms and, at the same time, the closed containers are removed from the closing device. Here as well, the containers are positioned on plates in the sealing station. However, the positioning is imprecise and the transport takes a lot of time since a supply and a removal can only take place when the sealing station is opened and during this time no operation for evacuating, introduction of gas and sealing of the containers is possible.

In these packaging machines the sealing station is arranged in the main transport path of the containers between a supply device and a removal device and a specific amount of containers is each time inserted into the sealing station, thereafter sealed therein and after sealing transported on to the removal device. Not until this is finished, the following containers can be transported into the sealing station and, therefore, the process in the sealing station takes a relatively long time since not only the time of sealing but additionally the transport time arises. During this time the containers to be sealed next have to wait until the sealing station becomes vacant.

Furthermore, the applicant knows an improved packaging machine in which two receiving plates for receiving the containers are provided in the sealing station. In a position which is located in the main transport path of the containers from the supply conveyor belt to the removal device, sealed containers are removed from one receiving plate and the receiving plate is supplied with containers to be sealed while, on the other receiving plate in a second position which is located lateral of the main transport path, containers are sealed with the upper film in a sealing tool. This leads to an increase of the effective operating time of the sealing tool and, thus, the operating speed of the packaging machine can be increased.

In the known packaging machine the two receiving plates are located on a rotary table and the motion of the receiving plates into the respective other position is performed by a rotation of the rotary table around a vertical axis. A relatively large space is needed in the horizontal direction perpendicular to the main transport path for the rotary motion which is in particular problematic when the packaging machine is used in small rooms. Furthermore, relatively long trajectories have to be covered between the two positions of the receiving plates in the rotary motion and accelerations having rotary components as well as translatory components occur, thus limiting the possible transport speed.

SUMMARY OF THE INVENTION

It is an object of the present invention to create a cost-efficient packaging machine which allows increasing the operation speed of the closing station and at the same time provides for an easy change over of the packaging machine to different package sizes and geometries, and to provide a method allowing for these advantages.

The object is attained by a packaging machine according to embodiments of the invention as set forth below and specified in the claims.

The packaging machine according to the invention has the advantage that the transport of the containers to the sealing tool and out of the sealing tool again can take place in a very fast way, and that for evacuating, introducing gas and closing of the containers a maximum process time is available since the closing device has to be open for a short time only.

It is a further advantage of the present invention that the packaging machine can easily be changed over to different container sizes and shapes and that in particular when only the height of containers is different no change over is necessary at all.

Furthermore, due to the employed linear motion of the plates into the closing device and out of the closing device, respectively, the packaging machine according to the invention can be realised significantly more cost-efficient than packaging machines using rotary motions. For this reason, the packaging machine can be formed in a space-saving manner in the direction perpendicular to the main transport path.

BRIEF DESCRIPTION OF THE DRAWINGS

Further features and advantages of the invention will arise from the description of embodiments with reference to the enclosed figures. The figures show.

DETAILED DESCRIPTION OF EMBODIMENTS OF THE INVENTION

In the following, a first embodiment of the present invention is described with reference to FIGS. 1 to 4.

Figure 2:
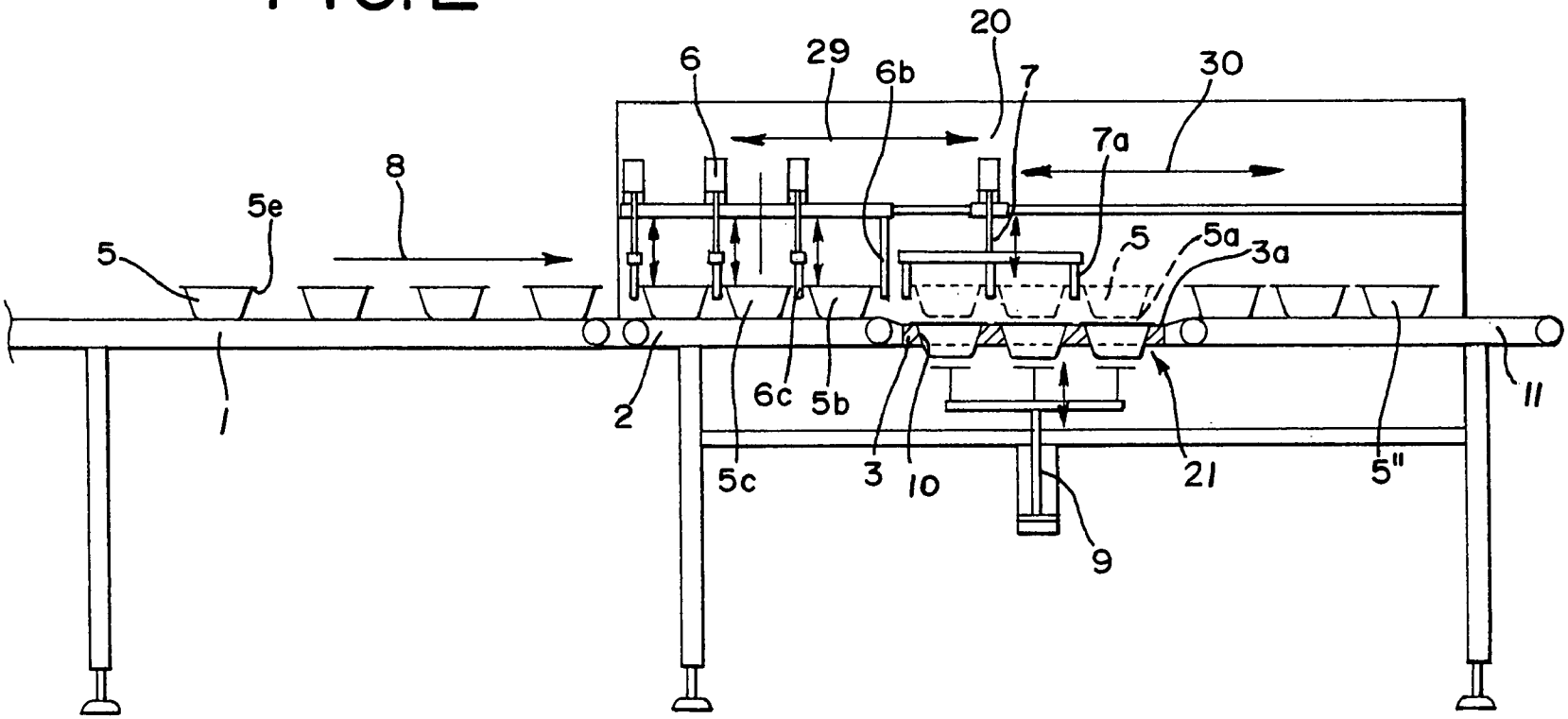
FIG. 2 a sectional side view of the packaging machine of FIG. 1.

As shown in FIG. 2, the packaging machine of this embodiment includes a first supply conveyor belt 1 on which containers 5 to be closed are transported in direction to a closing station 20, a second supply conveyor belt 2 which is arranged in the input region of the closing station 20 and on which the containers 5 are grouped, as well as a removal conveyor belt 11 on which the containers 5" are transported on after the processing in the closing station 20. The closing station 20 is formed such that a set of containers 5 can be processed simultaneously.

Via the first supply conveyor belt 1, the second supply conveyor belt 2 and the removal conveyor belt 11 the containers move along a main transport path in a main transport direction 8 which is indicated by an arrow in FIG. 2 and runs from the left to the right. The supply conveyor belts 1, 2 each run continuously and the grouping of the containers in the closing station 20 is performed by stoppers 6 arranged above the second supply conveyor belt 2.

The stoppers 6 are formed such that they can separately be moved from an elevated position in which the containers 5 on the second supply conveyor belt 2 can be transported underneath into a lowered position in which they stop containers 5 transported on the second supply conveyor belt 2 in the main transport direction 8 while the second conveyor belt 2 moves on underneath. Further, the stoppers 6 are formed such that they can be reciprocated in the main transport direction 8 by a control device which is not shown (29).

A site referred to as a first position 21 for a receiving plate 3 is located in the closing station 20 behind the second supply conveyor belt 2 in the main transport path. In the first position 21 the receiving plate 3 is arranged such that the containers 5 stopped on the second supply conveyor belt 2 by the stoppers 6 can be shifted above the receiving plate 3 by a movement of the lowered stoppers 6 in the main transport direction 8. Inside the receiving plate 3 recesses 10 are provided into which the containers 5 which are shifted above the receiving plate 3 can be lowered by means of a lifting device 9 provided below the receiving plate 3. Then, the lowered containers 5 are held at the upper container rim 5*e* by the receiving plate 3. A number of recesses 10 which corresponds at least to the number of containers 5 per set is provided in the receiving plate 3. It is also possible to simply drop the containers into the recesses without making use of the lifting device 9.

In the first position 21, sealed containers 5" can be lifted up in the recesses 10 of the receiving plate 3 by means of the lifting device 9 such that the container bottoms 5*a* are aligned with the upper side 3*a* of the receiving plate 3 located in the first position 21. Furthermore, a pusher 7 is provided which comprises drivers 7*a* protruding from above which are formed such that they reach between the sealed containers 5" in a first position as illustrated in FIG. 2. By shifting the pusher 7 in the direction of the main transport direction 8 into a second position (right end of arrow 30 in FIG. 2) the sealed containers 5" are shifted onto the removal conveyer belt 11.

Figure 1:
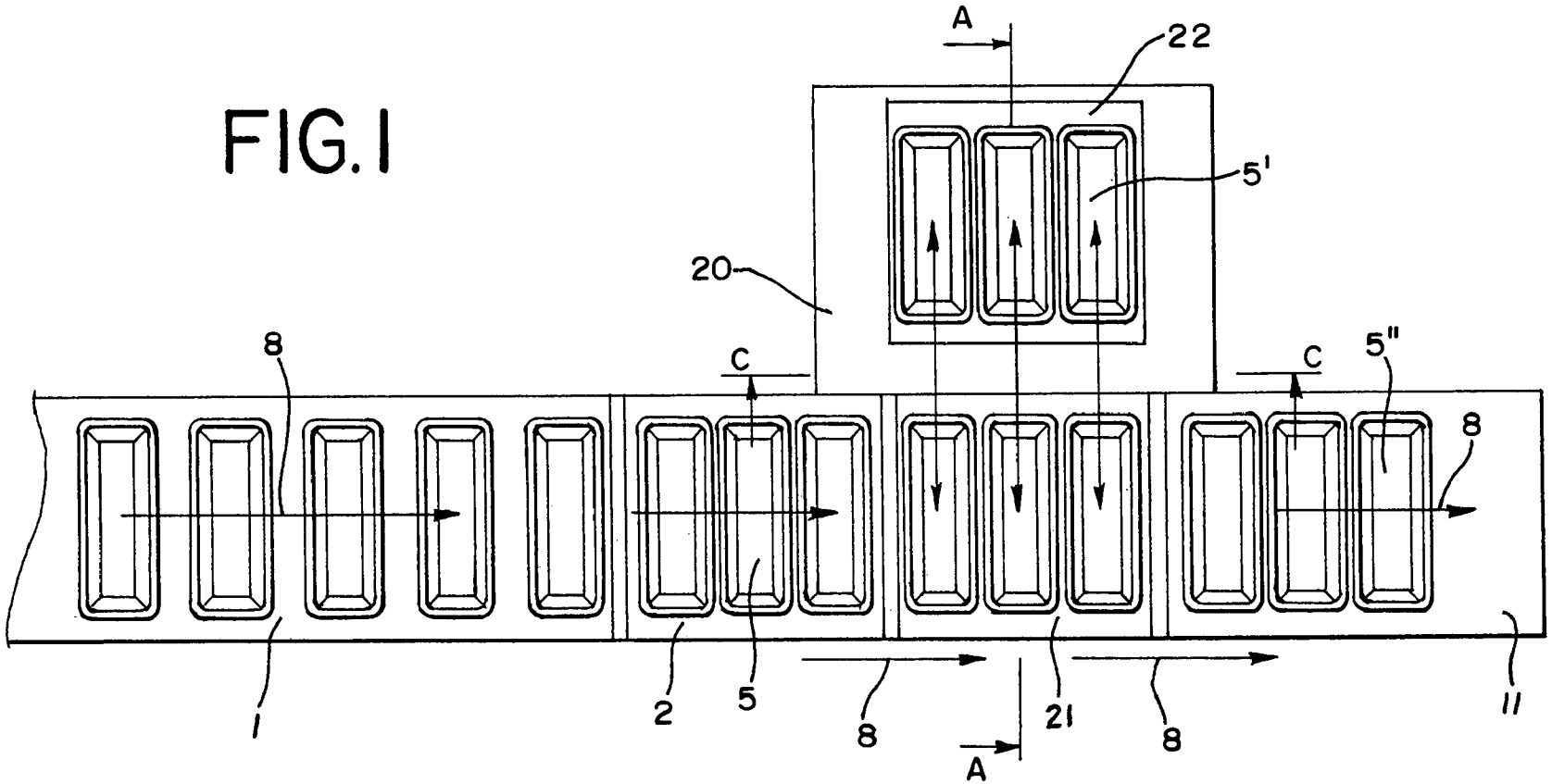
FIG. 1 a top view onto a schematic illustration of a packaging machine according to one embodiment of the present invention.
Figure 3:
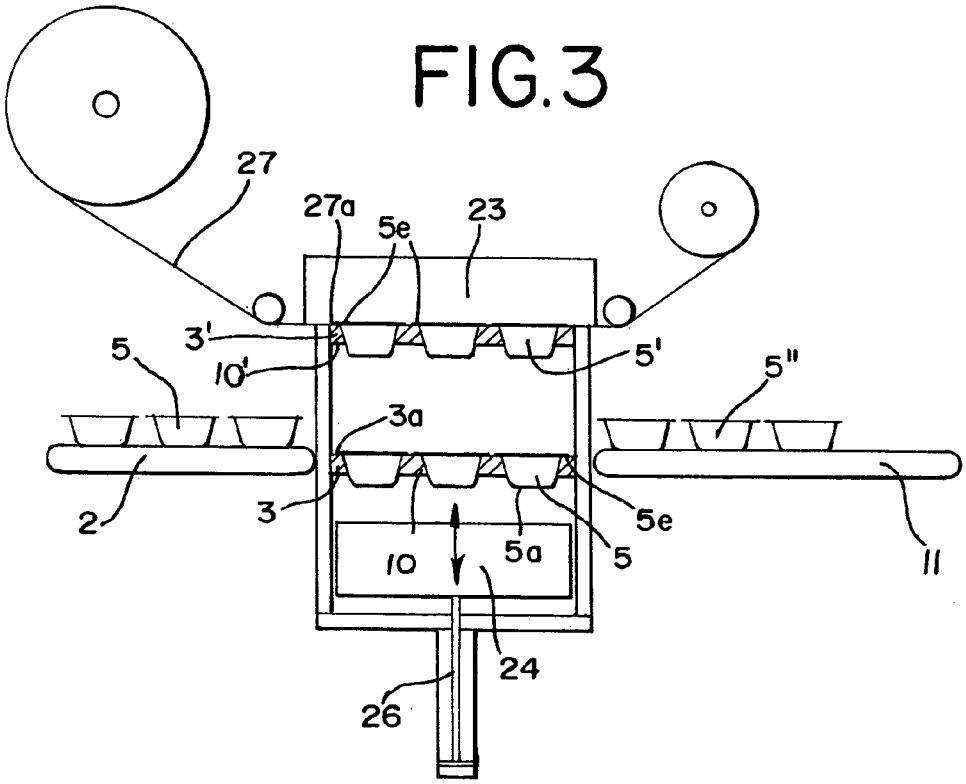
FIG. 3 a schematic sectional side view of part of the packaging machine of FIG. 1.
Figure 4:
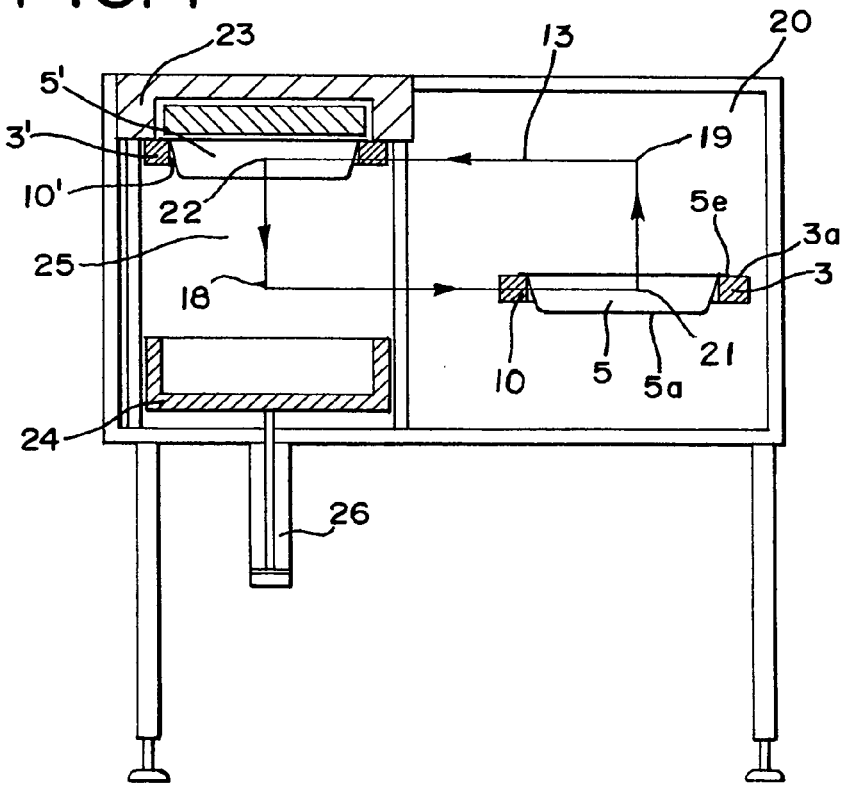
FIG. 4 a sectional view taken along the line A-A in FIG. 1.

Referring to FIGS. 1, 3 and 4, the closing station 20 is described in more detail in the following. As shown in FIG. 4, a second receiving plate 3' having recesses 10' and formed identical to the receiving plate 3 is located in the closing station 20 at a site referred to as second position 22. The second position 22 is located lateral of the main transport path and further up than the first position 21.

A transport mechanism is provided which is not shown and with which the receiving plates 3, 3' can be moved along the arrow line 13 in the direction of the arrow from the first position 21 via a second intermediate position 19 into the second position 22 and from the second position 22 via a first intermediate position 18 into the first position 21, respectively. This motion from the first position 21 to the second position 22 and back, respectively, is realised by two consecutive linear motions such that a rectangular trajectory is given, as is shown in FIG. 4.

When in the second position 22, the receiving plate 3' is located in-between an upper part 23 and a lower part 24 of a closing device 25. The lower part 24 is movable upward by means of a lifting device 26 such that the lower part 24 together with the upper part 23 and the receiving plate 3' pressed therebetween forms a closed chamber. Additionally, devices which are not shown in the drawing are provided at this closing device 25 allowing for an evacuating and a supply of gas such as an inert gas.

As shown in FIG. 3, an upper film 27 is located in the region of the closing device 25 such that a portion 27*a* of the upper film 27 is sandwiched between the upper part 23 and the receiving plate 3' when the closing device 25 is closed, with the result that this portion comes to rest on the upper container rims 5*e* of the containers 5' held in the recesses 10' of the receiving plate 3'.

The upper side of the receiving plate 3' and the upper part 23 are formed such that they form a sealing and cutting tool sealing the upper film 27 onto the upper container rims 5*e* and in doing so cutting free the sealed region from the upper film 27. Furthermore, the closing device 25 is formed such that it opens after sealing of the containers 5' and a following portion of the upper film is moved into the closing device 25.

In the following, the operation of the packaging machine is described with reference to FIGS. 1 to 4. During operation, irregularly spaced containers 5 are transported on the first supply conveyor belt 1 in the direction towards the second supply conveyor belt 2. The containers 5 are already filled with products to be packaged. The filling may be performed on the first supply conveyor belt 1 or even before it. The containers 5 are transferred from the first supply conveyor belt 1 to the second supply conveyor belt 2. The first container 5*b* is transported on the second supply conveyor belt 2 in the main transport direction 8 until it abuts onto the first stopper 6*b* which inhibits the continuation of its motion. The second supply conveyor belt 2 moves on underneath the held first container 5*b*. Then, the following stopper 6*c* moves down behind the first container and, coming from the first supply conveyor belt 1, the following container 5*c* is moved on the second supply conveyor belt 2 in the main transport direction 8 until it abuts onto the stopper 6*c*. Thereafter, the following stopper is moved down and the procedure recurs until a pre-set number of containers 5 are grouped. The distance of the containers 5 of one set is adjusted by the distance of the stoppers relative to each other.

Afterwards, the stoppers 6 are moved in the main transport direction 8 (arrow 29 to the right) and the grouped containers 5 are moved above a receiving plate 3 located in the position 21. At the same time, sealed containers 5" which are located on the receiving plate 3 are moved onto the removal conveyor belt 11 by the pusher 7. The grouped containers 5 which were moved above the receiving plate 3 are lowered into the recesses 10 of the receiving plate 3 by the lifting device 9 or simply dropped into the recesses 10 and then held therein by the upper rim 5*e* of the containers 5. During the time when the sealed containers 5" are moved onto the removal conveyor belt 11 by the pusher and the grouped containers 5 are moved into the recesses 10 of the receiving plate 3, containers 5' which are located on the receiving plate 3' are sealed in the closing device 25.

After the sealing process in the closing device 25 is completed and the containers 5 to be closed have been placed in the recesses 10 of the receiving plate 3 which is located in the first position 21, the closing device 25 is opened by lowering the lower part 24 with the lifting device 26. As is illustrated in FIG. 4, thereafter the receiving plate 3' is linearly lowered in the vertical direction into a first intermediate position 18 having the height of the first position 21 from the second position 22 which is arranged lateral of the main transporting path and higher than the first position 21. At the same time, the other receiving plate 3 is linearly moved in the vertical direction from the first position 21 into a second intermediate position 19. Thereafter, the receiving plate 3' containing sealed containers 5" is linearly moved in the horizontal direction from the first intermediate position 18 into the first position 21. At the same time, the receiving plate 3 with the unsealed containers 5 is linearly moved in the horizontal direction from the second intermediate position 19 into the second position 22 in the closing device 25 such that the receiving plates 3, 3' have interchanged their positions.

Subsequently the closing device 25 is closed and the containers 5' on the receiving plate 3 located therein are sealed with the upper film 27 and, thereafter, the closing device opens again. At the same time, the sealed containers 5" in the receiving plate 3' in the first position 21 are lifted up with the lifting device 9 and moved onto the removal conveyor belt 11 by the pusher 7, while containers 5 which were in the meantime grouped on the second supply conveyor belt 2 are moved above the receiving plate 3' by the stoppers 6 and are subsequently lowered into the recesses 10' of the receiving plate 3' by means of the lifting device 9 or simply dropped into the same.

When the sealing process in the closing device 25 is finished and the following grouped containers 5 were placed in the recesses 10', the receiving plate 3' is moved from the first position 21 via the second intermediate position 19 into the second position 22 and, at the same time the other receiving plate 3 is moved from the second position 22 via the first intermediate position 18 into the first position 21. Subsequently, the described processes recur with the result that further containers 5 are successively sealed.

The packaging machine may also be realised such that the respective receiving plates 3, 3' are moved from the first position 21 via the first intermediate position 18 into the second position 22 and from the second position 22 via the second intermediate position 19 into the first position 21, that means contrary to the direction of arrows shown in FIG. 4.

By providing more than one receiving plate 3, 3', the operating speed of the packaging machine can be enhanced since the closing device 25 must be opened shortly only for altering the position of the receiving plates 3, 3', and the sealing process and a main part of the container transport are performed at the same time such that occurring dead times of single components of the packaging machine can be significantly reduced.

Due to the linear motions of the receiving plates 3, 3' from the first position 21 into the second position 22 and back, lower accelerations act onto the plates and the motions can be performed in a faster manner such that an additional time saving occurs. Moreover, the linear motions are more easily realisable as compared to rotary motions and, thus, can be implemented more cost-efficiently. Furthermore, a construction which is narrower in the horizontal direction perpendicular to the main transport direction is possible and this is in particular advantageous when only small rooms are available for the packaging machine. If enough room is available laterally, several containers can be processed arranged side by side in the direction perpendicular to the main transport direction without increasing the width of the machine as compared to known packaging machines.

It is in particular advantageous that an easy change over to different container sizes and shapes is allowed for. If, for example, only containers of different height shall be used, then, no change over is necessary since the containers 5, 5', 5" are held in the recesses 10, 10' with their upper rim 5*e* and, thus, the height of the flange region in which the sealing is performed is unchanged in the positioning in the closing device 25. When the packaging machine shall be changed over to another shape of containers only the receiving plates 3, 3' and the upper part 23 of the closing device 25 have to be substituted and the lower part 24 of the closing device can be maintained. Thus, an easy and cost-efficient change over to different container sizes and shapes can be carried out.

Though the grouping of containers is carried out in a very specific advantageous way in the described embodiment, the grouping may also be realised in a different way, such as by a supply device operating in an intermittent way and/or by a gripper gripping the set in a predetermined way for transport.

What is claimed is:

1. A packaging machine for closing containers, comprising:

a supply device for supplying containers to be closed; a removal device for removing closed containers; and a closing device between the supply device and the removal device;

wherein the closing device is arranged laterally of a main transport path of the containers from the supply device to the removal device;

and wherein a device is provided which transports at least one container to be closed into a position located laterally of the main transport path in the closing device by means of a linear motion while said device transports at least one closed container out from the position located laterally of the main transport path wherein at least first and second receiving elements are provided which simultaneously interchange their position for transporting a container to be closed into the closing device and transporting a closed container out from the closing device.

2. A packaging machine according to claim 1, wherein a transport device is provided which is structured to remove, a closed container from the second receiving element and to supply a container to be closed to the second receiving element, while the first receiving element is in the closing device for closing of a container.

3. A packaging machine according to claim 1, wherein the receiving elements are plates having recesses into which the containers are inserted.

4. A packaging machine according to claim 1, wherein one receiving element receives a plurality of containers at a time.

5. A packaging machine according to claim 1, wherein the device for transporting the container into the closing device and for transporting the closed container out from the closing device performs a vertical linear motion and a horizontal linear motion.

6. A packaging machine according to claim 1, wherein a plurality of containers is closed at the same time.

7. A packaging machine according to claim 1, wherein a grouping device or an additional intermittent supply device is provided which groups the containers on the supply device.

8. A packaging machine according to claim 1, wherein the closing device is a sealing device in which a film is sealed onto the container.

* * * * *